US005682824A

United States Patent [19]

Visk

[11] Patent Number: 5,682,824

[45] Date of Patent: Nov. 4, 1997

[54] DISPLAY SHELF SYSTEM

[75] Inventor: John Visk, Chicago, Ill.

[73] Assignee: RTC Industries Inc., Rolling Meadows, Ill.

[21] Appl. No.: 602,870

[22] Filed: Jan. 29, 1996

[51] Int. Cl.[6] ..... A47B 57/00

[52] U.S. Cl. ..... 108/60; 108/61; 211/184

[58] Field of Search ..... 108/60, 61; 248/223.41, 248/298.1; 211/184, 43, 94; 40/642

[56] References Cited

U.S. PATENT DOCUMENTS

| | | | |
|---|---|---|---|
| 4,712,694 | 12/1987 | Breslow | 108/61 X |
| 4,735,324 | 4/1988 | Wilcek | 211/184 |
| 5,161,704 | 11/1992 | Valiulis | 108/61 X |
| 5,209,357 | 5/1993 | Cannon | 108/61 X |

FOREIGN PATENT DOCUMENTS

| | | | |
|---|---|---|---|
| 1360555 | 3/1964 | France | 108/61 |

*Primary Examiner*—Peter M. Cuomo
*Assistant Examiner*—Janet M. Wilkens
*Attorney, Agent, or Firm*—Jack Shore

[57] ABSTRACT

A shelf system including a rail member and a plurality of shelf dividers. The shelf divider includes a longitudinally extending portion which has formed at its front end an integral flexible undulated C-shaped member disposed normal to the longitudinally extending portion. The divider includes at its front end a cutout whereby the divider and flexible member can be readily compressed so that the flexible member can be snap-fitted into channels formed by the rail member and the divider positioned relative thereto against accidental movement.

3 Claims, 1 Drawing Sheet

DISPLAY SHELF SYSTEM

TECHNICAL FIELD

This invention relates to a merchandise display shelf system and particularly to an improved divider to assist in organizing and dividing existing display shelf assemblies.

BACKGROUND OF THE INVENTION

In recent years, there has been a growing trend toward self-service merchandising in a wide variety of stores, such as groceries, supermarkets, drug stores, and so forth. In these stores, the merchandise is displayed on shelves from which the customer makes its selection. The article to be purchased is then taken to a central checkout counter or cashier. It is very important that there be efficient use of the shelf space since shelf space is very limited and it is essential that the products be organized in an appealing way to accomplish effective merchandising.

A conventional shelf assembly which is of a standard length, such as 3 or 4 feet, is divided into vertical sections to provide bins of suitable widths to accommodate various products. Each bin contains easily visible information relating to pricing, advertising copy, and other consumer information. Due to the varying product shapes and sizes and the frequent change in promotions and sales, and so forth, there is a need and desire to provide for quick adjustability of the product spacing in the shelf systems employed. It is also required that after the shelf dividers are repositioned they positively remain where they are placed.

While there are currently various adjustable shelving systems available, there is the constant need to improve the assembly to enhance the ease with which shelves can be adjusted to accommodate varying products.

SUMMARY OF THE INVENTION

The present invention provides for a shelf system that includes a novel type of vertical divider panel that can be readily adjusted to provide for different widths of shelf space and when located in position will positively remain as located so as not to be moved out of position inadvertently. Normally, the shelf system comprises an assembly consisting of a front stop rail and a plurality of vertical dividers that are mounted on a shelf. The vertical dividers are adapted to be slidably and releasably obtained by the stop rail. The stop rail usually includes a horizontal leg section attachable to an existing shelf and a vertical front face for application of advertising material or the like.

In accordance with the present invention, the divider includes a longitudinally extending panel section and a resilient integral C-shaped plastic member at the front portion of the divider and disposed normal to the panel section. The outer portions of the legs of the legs of the C-shaped member are adapted to fit into upper and lower channel-shaped flanges defined by the front stop rail. The back of the C-shaped member is undulated to give it flexibility and when located in position in the rail member is maintained in position by being resiliently biased against the inner surface of the rail member and the channel sections thereof. To facilitate flexing of the front portion of the vertical divider, it defines a gap at the front end to permit flexing thereof and facilitate introduction of the upper and lower portions of the C-shaped member into the aforementioned channel sections. The rail and the vertical dividers are preferably molded of available clear plastics.

Other advantages and features of the present invention will become readily apparent from the following detailed description of the invention taken in conjunction with the accompanying drawings.

DETAILED DESCRIPTION OF THE INVENTION

Figure 1:
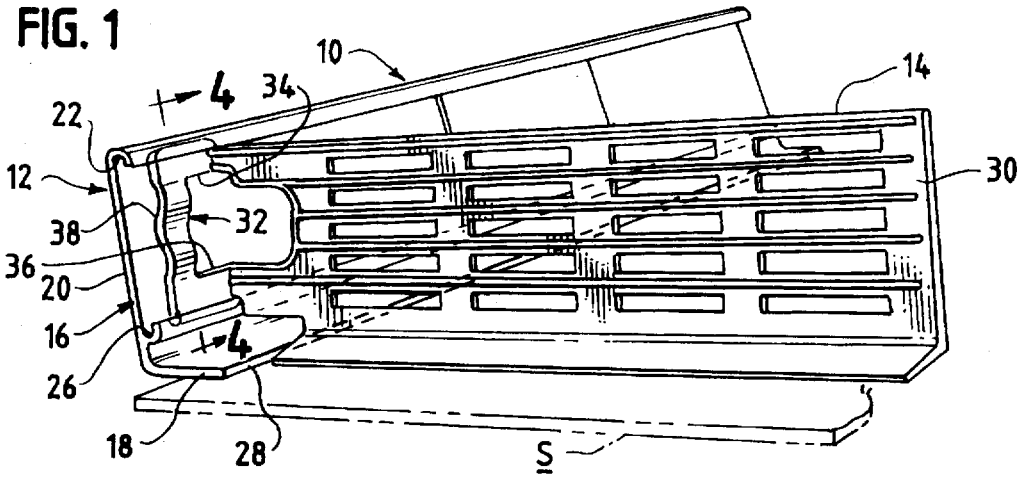
FIG. 1 is a perspective view of the shelf system mounted on display shelf.

Referring to the figures of the drawings, it is seen that the novel system includes a vertically disposed shelf system 10 which embodies the principle of the invention. The shelf system 10 consists of a front rail member 12 and spaced vertical divider members 14, only one of which is shown, that can be moved transversely relative to the rail member 12 to provide for the requisite shelf spacing and when located will be fixed in position relative to the rail member.

The rail member 12 comprises a L-shaped member 16 having a horizontal mounting foot 18 and a vertical rail leg 20. The rail leg 20 defines an integral channel 22 extending from its upper edge and an integral channel 26 extending from its inner surface slightly above the horizontal mounting foot 18. The rail member 12 preferably is made in standardized lengths such as 2 or 3 feet and the leg 20 is formed with spaced mounting holes (not shown) to facilitate mounting relative to the shelf S on which it is to be located. The rail member 12 can be suitably secured by fastening means (not shown) to connect it to the front portion of a shelf S. The rail leg 20 preferably tapers rearwardly to a relatively thin edge 28 and thereby provides minimal resistance to products on the shelf S being slid thereover onto the leg.

Figure 2:
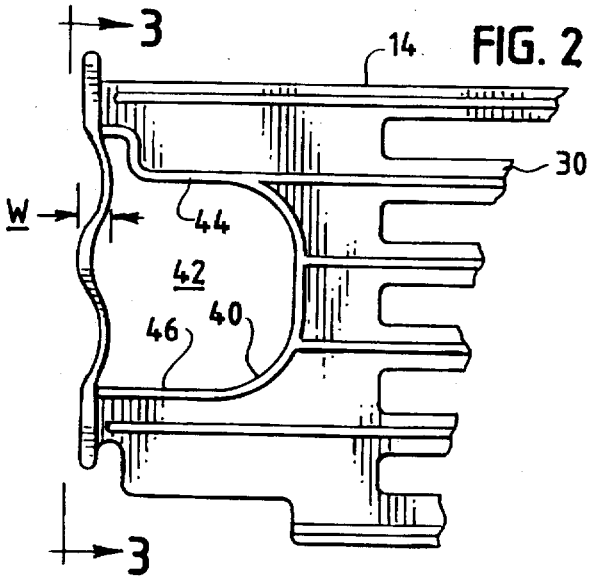
FIG. 2 is partial side elevational view of the shelf divider.
Figure 3:
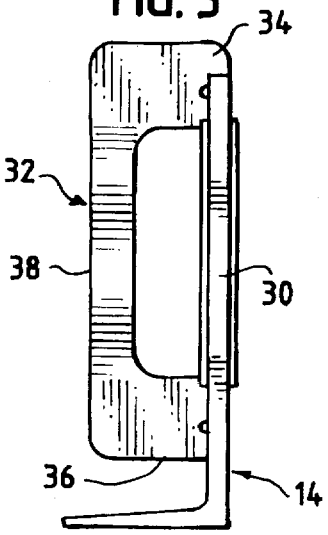
FIG. 3 is a front view taken along line 3—3 of FIG. 2.
Figure 4:
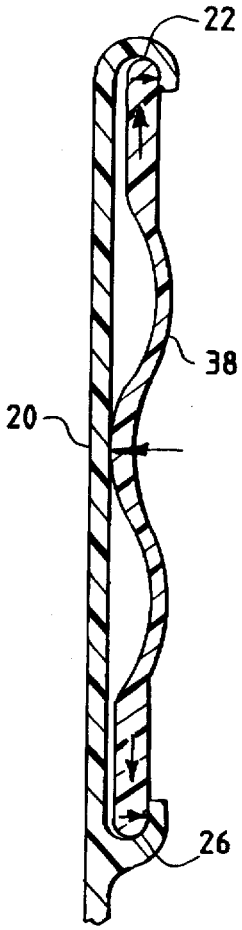
FIG. 4 s a cross-sectional view taken along a line 4—4 of FIG. 1.

In the illustrated embodiment, which is not limiting, the divider member 14 comprises an elongated vertically disposed panel 30 normally having a vertical height substantially equal to the height of the rail leg 20, but they can be taller or smaller if desired. Disposed normal to and formed integral with the front edge of the divider member 14 is a C-shaped, flexible member 32 having leg portions 34, 36 and a back undulated portion 38. These shapes are currently being employed, but are not intended to be limiting. The undulated portion is provided to permit flexing of the front end of the panel and has a width W (see FIG. 2) that is slightly wider than that of the channel section so that when it is slid into position as shown in FIG. 4 forces are imposed indicated by the illustrated arrows to resiliently maintain the member 32 in position relative to the rail member so it will not move relative thereto when located in the position shown.

To permit flexing of the front portion of the vertical divider member 14 a cutout 40 is formed therein to provide gap 42 which facilitates a limited amount of compressibility between the front upper portion 44 and lower portion 46 of the front of the divider 14. When the front of the divider is compressed, the integral, undulated, flexible member is similarly flexed. Thus, upon compressing the front portions 44, 46 of the vertical divider member 14, the upper and lower portions 34, 36 of the undulated member 32 can be snap-fitted into the top and bottom channel sections 22, 26 of the rail member. In this position, the member 32 engages the inner face of the rail leg and an inner wall of the channels 22,26. When desired, the flexibility of the front portion of the divider permits the lateral sliding of the divider to any desired position. The operationally connected divider may be readily disconnected if desired by compressing and rotating the flanges to release them from the associated rails. The L-shaped base of the vertical divider provides stability of the divider relative to the shelf support.

The divider members are preferably made in a standard length corresponding to the common depth of the existing such as 12 inches. As aforementioned, each of the members preferably is integrally molded from suitable available transparent plastics.

It will be apparent from the foregoing description and illustrative embodiment that numerous variations and modifications may be made without affecting the true spirit and scope of the invention.

What is claimed is:

1. A shelf system comprising an elongated L-shaped rail member having a horizontal mounting foot and a vertical rail leg, said mounting foot being attachable to a shelf, upper and lower receiving channels integrally formed on the inner face of said rail leg, an elongated longitudinally extending divider panel having a front end portion, a C-shaped thin resilient member integral with and extending normal to and across the front end of the divider panel including an intermediate undulated portion and a cut-out defined by the front end of said panel defining a gap whereby said resilient member is resiliently compressible to permit the snap-fitting of said resilient member into said receiving channels for resiliently mounting said panel to said rail leg and being effective to maintain the panel in position by maintaining pressure against said vertical rail leg in said receiving channels.

2. A shelf system in accordance with claim 1 in which the width of the undulated portion is slightly greater than that of the channels to further assist in maintaining the C-shaped resilient member in position relative to the rail member.

3. A shelf system comprising an elongated rail member having a bottom mounting portion and an upper portion extending upwardly from the mounting portion, said mounting and upper rail portion together defining a generally L-shaped cross section for said rail member, said mounting portion being attachable to an upper surface of a shelf, the inner surface of said rail member defining upper and lower channel means, a divider member comprising an elongated longitudinally extending panel having a front end portion that defines a gap formed by a cut-out portion, a resilient connector means integral with the front end of the panel, which connector means extends across a major portion of the front end of the panel including the cut-out portion and is disposed normal to the panel, said connector means including an intermediate curved section and including transversely extending upper and lower portions positionable in said upper and lower channel means, said panel being configured to permit the upper and lower portions of the connector means to be resiliently compressed toward each other so that said upper and lower portions are snap-fittable into said channel means to operationally mount said divider member in a substantially vertical orientation and normal to said rail in which position the divider member is positively maintained in position relative to said rail member.

* * * * *